US010377969B2

(12) United States Patent
Letzelter et al.

(10) Patent No.: US 10,377,969 B2
(45) Date of Patent: Aug. 13, 2019

(54) PROCESS FOR MAKING A PARTICLE

(71) Applicant: The Procter & Gamble Company, Cincinnati, OH (US)

(72) Inventors: Nathalie Sophie Letzelter, Trimdon (GB); Julie Ellis, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 26 days.

(21) Appl. No.: 15/643,504

(22) Filed: Jul. 7, 2017

(65) Prior Publication Data

US 2018/0010072 A1 Jan. 11, 2018

(30) Foreign Application Priority Data

Jul. 8, 2016 (EP) ..... 16178670

(51) Int. Cl.

| | |
|---|---|
| ***C11D 3/20*** | (2006.01) |
| ***C11D 3/33*** | (2006.01) |
| ***C11D 3/37*** | (2006.01) |
| ***C11D 1/75*** | (2006.01) |
| ***C11D 17/00*** | (2006.01) |
| ***C11D 3/39*** | (2006.01) |
| ***C11D 3/50*** | (2006.01) |
| ***C11D 7/32*** | (2006.01) |
| ***C11D 17/06*** | (2006.01) |
| ***C11D 1/66*** | (2006.01) |
| ***C11D 3/00*** | (2006.01) |
| ***C11D 11/00*** | (2006.01) |
| ***C11D 17/04*** | (2006.01) |
| *C11D 3/386* | (2006.01) |
| *C11D 3/395* | (2006.01) |

(52) U.S. Cl.

CPC ..... *C11D 3/2082* (2013.01); *C11D 1/66* (2013.01); *C11D 1/75* (2013.01); *C11D 3/0068* (2013.01); *C11D 3/2075* (2013.01); *C11D 3/33* (2013.01); *C11D 3/378* (2013.01); *C11D 3/3769* (2013.01); *C11D 3/3942* (2013.01); *C11D 3/50* (2013.01); *C11D 7/3209* (2013.01); *C11D 11/0088* (2013.01); *C11D 17/0091* (2013.01); *C11D 17/044* (2013.01); *C11D 17/06* (2013.01); *C11D 3/38609* (2013.01); *C11D 3/395* (2013.01)

(58) Field of Classification Search

None

See application file for complete search history.

(56) References Cited

U.S. PATENT DOCUMENTS

| | | | | |
|---|---|---|---|---|
| 5,292,446 | A | 3/1994 | Painter et al. | |
| 5,308,532 | A | 5/1994 | Adler et al. | |
| 5,856,164 | A | 1/1999 | Outtrup et al. | |
| 7,871,974 | B2 | 1/2011 | Somerville Roberts et al. | |
| 8,183,196 | B2 | 5/2012 | Somerville Roberts et al. | |
| 2005/0061704 | A1 | 3/2005 | Cole et al. | |
| 2005/0202995 | A1 | 9/2005 | Waits et al. | |
| 2006/0172910 | A1* | 8/2006 | Brooker | C11D 17/042 510/293 |
| 2008/0193999 | A1 | 8/2008 | Andersen et al. | |
| 2009/0032063 | A1 | 2/2009 | Haas et al. | |
| 2010/0240759 | A1 | 9/2010 | Haake | |
| 2012/0004147 | A1* | 1/2012 | Seetz | C09K 8/536 507/211 |
| 2013/0136712 | A1 | 5/2013 | Woo et al. | |
| 2014/0116472 | A1* | 5/2014 | Dahlquist | C11D 7/06 510/475 |
| 2015/0166943 | A1 | 6/2015 | Campbell et al. | |
| 2016/0145547 | A1 | 5/2016 | Michaels et al. | |
| 2016/0160158 | A1 | 6/2016 | Tuerk et al. | |
| 2016/0177230 | A1 | 6/2016 | Souter | |
| 2016/0177237 | A1 | 6/2016 | Souter et al. | |
| 2016/0222321 | A1 | 8/2016 | Letzelter et al. | |
| 2016/0222325 | A1* | 8/2016 | Letzelter | C11D 3/3761 |
| 2016/0222330 | A1* | 8/2016 | Letzelter | C11D 3/386 |
| 2017/0191004 | A1* | 7/2017 | Schmaelzle | C11D 3/0073 |

FOREIGN PATENT DOCUMENTS

| | | | |
|---|---|---|---|
| EP | 0 504 091 | A1 | 9/1992 |
| JP | 2013-527272 | A | 6/2013 |
| JP | 2014-040565 | A | 3/2014 |
| JP | 2014-040586 | A | 3/2014 |
| JP | 2016035009 | A | 3/2016 |
| WO | WO 94/22800 | A1 | 10/1994 |
| WO | WO 96/23873 | A1 | 8/1996 |
| WO | WO 99/23211 | A1 | 5/1999 |
| WO | WO 00/37627 | A1 | 6/2000 |
| WO | WO 00/60060 | A2 | 10/2000 |
| WO | WO 02/20361 | A1 | 3/2002 |
| WO | WO201417565 | A1 | 1/2014 |
| WO | WO 2014/085215 | A1 | 6/2014 |

OTHER PUBLICATIONS

Extended European Search Report; Application No. 16178670.2-1375; dated Jan. 12, 2017; 13 pages.

* cited by examiner

*Primary Examiner* — Lorna M Douyon
(74) *Attorney, Agent, or Firm* — John T. Dipre

(57) ABSTRACT

A process for making a particle, the particle includes: a) a nitrogen-containing cleaning-active in the form of a salt wherein the salt has a pH in 1% weight aqueous solution measured at 25° C. greater than 9; and b) a malodor-reducing agent including an acid group wherein the process includes the step of adding the malodor-reducing agent to the nitrogen-containing cleaning-active wherein the malodor-reducing agent is added in the absence of water.

10 Claims, 1 Drawing Sheet
(1 of 1 Drawing Sheet(s) Filed in Color)

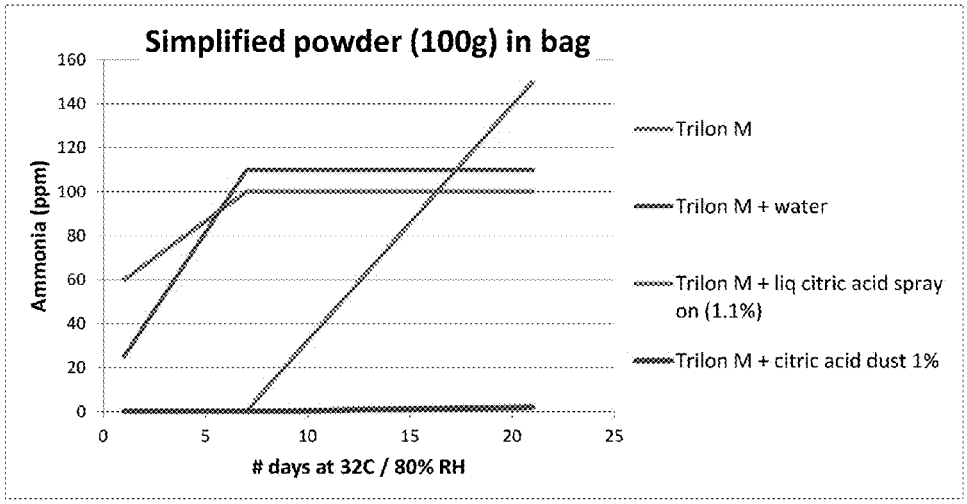
Simplified powder (100g) in bag
Ammonia (ppm)
160
140
120
100
80
60
40
20
0
0
5
10
15
20
25
# days at 32C / 80% RH
Trilon M
Trilon M + water
Trilon M + liq citric acid spray on (1.1%)
Trilon M + citric acid dust 1%

PROCESS FOR MAKING A PARTICLE

TECHNICAL FIELD

The present invention is in the field of particles. In particular, it relates to a process for making a particle comprising a nitrogen-containing cleaning-active and a malodour-reducing agent. The particle presents good olfactory profile and is particularly suitable for use in cleaning compositions, in particular in automatic dishwashing compositions.

BACKGROUND OF THE INVENTION

Nitrogen-containing materials can be prone to malodour generation. The malodour can come from by-products generated during the manufacturing process. Nitrogen containing materials can be useful in cleaning compositions however they can interact with other components of the composition and give rise to malodours.

Cleaning detergent compositions are usually perfumed. Powdered cleaning products usually include perfume sprayed onto the powder. Liquid cleaning products usually include perfume dissolved/emulsified therein. In traditional products, part of the perfume is released from the composition into the headspace of the pack providing a pleasant smell when the pack is opened or at least for the first few times. Consumers associate the pleasant smell with cleaning and expect to perceive an agreeable smell when the pack is opened.

Water-soluble cleaning products in unit dose form have become widely spread. The products consist of enveloping water-soluble material that wraps the cleaning composition. The products are stored in a pack, the pack is usually permeable to small molecules and in some cases the rate of malodour generation is faster than the rate of permeation of the malodour to the surrounding environment, in this condition the malodour can be concentrated in the headspace and it is released when the bag is opened, this malodour is not very pleasant and may connote lack of cleaning.

The objective of the present invention is to design cleaning products containing nitrogen-containing cleaning actives having a good olfactory profile.

SUMMARY OF THE INVENTION

According to the first aspect of the invention, there is provided a process for making a particle. The particle comprises:

a) a nitrogen-containing cleaning-active; and b) a malodour-reducing agent comprising an acid group, preferably a carboxylic acid group.

The nitrogen-containing cleaning-active is in the form of a salt, preferably an alkaline metal salt and more preferably a sodium salt. The nitrogen-containing cleaning-active has a pH measured in a 1% weight aqueous solution at 25° C. greater than 9, preferably greater than 10 and more preferably greater than 11.

By "nitrogen-containing cleaning-active" is herein meant a ingredient that actively contributes to cleaning and contains nitrogen, for example salts of aminocarboxylic complexing agents, amine oxide surfactants, cleaning and/or finishing polymers comprising amine functionalities, cleaning amines, etc. The nitrogen-containing cleaning-active can generate ammonia that can modify perfume characters and/or can be directly perceived by the user.

By "malodour-reducing agent" is herein meant a compound that reduces the amount of ammonia generated, as compared to a composition that does not have the compound, by more than 50%, preferably more than 90% when 0.5 g of the compound is mixed with 50 grams of a nitrogen-containing cleaning active, 13 grams of sodium percarbonate and 36.5 grams of sulfate when the mixture is stored in a seal bag, such as a zip lock bag made of laminated polyethylene (12 micron thickness) and laminated polyethylene terephthalate (80 microns). The bag dimensions being: 19 cm height, 8.2 cm width and 19 cm length. The bag is placed in a 32° C., 80% relative humidity oven for 2 weeks. The ammonia is measured by piercing the bag with an ammonia detector tube fitted to a Kitagawa (AP-20) gas aspirating pump to measure the concentration of airborne ammonia in the headspace of the bag. Specifically, to test whether a compound is a "malodour-reducing agent" within the meaning of the invention, 0.5 g of that compound, having a particle size of 40-70 microns are mixed with 50 grams of MGDA (particle size 400-600 microns, supplied by BASF) (such as Trilon M available from BASF) and 13 grams of sodium percarbonate and 36.5 grams of sodium sulfate. The malodour reducing agent comprises an acid group and it preferably has a pKa of less than 9, more preferably less than 7 and especially less than 5. Preferably, the acid group of the malodour-reducing agent is a carboxylic acid group.

The process comprises the step of adding the malodour-reducing agent to the nitrogen-containing cleaning-active. The malodour-reducing agent is added in the absence of water. To provide malodour reduction is important that the acid group in the malodour-reducing agent is in the protonated form. Without being bound by theory, it is believed that in presence of water the acid group might deprotonate when exposed to the alkaline nitrogen-containing cleaning-active and it will not be suitable to act as malodour-reducing agent.

Preferably the particle comprises from 90 to 99.5% of the nitrogen-containing cleaning-active by weight of the particle and from 0.5 to 10% of the malodour-reducing agent by weight of the particle.

The malodour-reducing agent can be added by firstly forming a pre-particle comprising the nitrogen-containing cleaning-active followed by admixing the pre-particle with the malodour-reducing agent to form the finished particle. A preferred way to add the malodour-reducing agent to the pre-particle is by dusting the pre-particle with the malodour-reducing agent.

Alternatively, the malodour-reducing agent can be added to the nitrogen-containing cleaning-active by using an anhydrous solution containing the nitrogen-containing cleaning-active. By "anhydrous solution" is herein meant a solution comprising less than 10%, preferably less than 5% and more preferably less than 1% by weight of the solution of water. Preferred materials for making the anhydrous solution include liquid polymers, non-ionic surfactants, hydrotropes, etc The particle obtained according to the process of the invention presents good stability in cleaning compositions and it has a good olfactory profile, even when part of a bleach-containing composition.

According to the second aspect of the invention, there is provided a particle obtained or obtainable according to the process of the invention.

According to a third aspect of the invention, there is provided a cleaning composition, preferably an automatic dishwashing cleaning composition, comprising the particle of the invention and preferably from 5 to 20% of bleach. The composition preferably comprises a perfume and it has a good olfactory profile.

There is also provided a detergent pack comprising the composition of the invention in the form of unit doses. The pack presents a good olfactory profile when it is open.

The elements of the process of the invention described in connection with the first aspect of the invention apply mutatis mutandis to the other aspects of the invention.

BRIEF DESCRIPTION OF THE DRAWINGS

The patent or application file contains at least one drawing executed in color. Copies of this patent or patent application publication with color drawings will be provided by the Office upon request and payment of the necessary fee.

FIG. 1 depicts the ammonia (ppm) generated over a period of time (days) of compositions stored at 32° C. and 80% relative humidity.

DETAILED DESCRIPTION OF THE INVENTION

The present invention encompasses a process for making a particle comprising a nitrogen-containing cleaning-active and a malodour-reducing agent comprising an acid group. The process gives rise to a particle with reduced or lack of malodour, even when the particle is placed in a cleaning composition comprising bleach. The invention also provides a particle obtained according to the process of the invention, a cleaning composition comprising the particle and a detergent pack comprising the composition, preferably an automatic dishwashing composition, in unit dose form.

Nitrogen-Containing Cleaning-Active

The nitrogen-containing cleaning active is preferably selected from salts of the group consisting of aminocarboxylic complexing agents, amine oxide surfactants, cleaning amines, polymers comprising nitrogen and mixtures thereof. Preferably the nitrogen-containing cleaning-active is an aminocarboxylic complexing agent.

Aminocarboxylic Complexing Agent

A complexing agent is a material capable of sequestering hardness ions, particularly calcium and/or magnesium.

The composition of the invention preferably comprises from 5% to 50% of complexing agent, preferably from 10 to 40% by weight of the composition. The complexing agent is preferably selected from the group consisting of salts of methyl-glycine-diacetic acid (MGDA), salts of glutamic-N, N-diacetic acid and mixtures thereof. Especially preferred complexing agent for use herein is a salt of MGDA, in particular the tri-sodium salt of MGDA.

Amine Oxide Surfactant

Amine oxides surfactants are useful for use in the composition of the invention. Preferred are C10-C18 alkyl dimethylamine oxide, and C10-18 acylamido alkyl dimethylamine oxide.

Amine oxide surfactants may be present in amounts from 0 to 15% by weight, preferably from 0.1% to 10%, and most preferably from 0.25% to 5% by weight of the composition.

Malodour Reducing Agent

Suitable materials for use as malodour reducing agents include monomeric or polymeric carboxylic acids. Preferred organic acids are citric acid, ascorbic acid, oxalic acid, adipic acid, succinic acid, glutaric acid, malic acid, tartaric acid, maleic acid, fumaric acid, sugar acids, fatty acids and mixtures thereof. Particularly preferred organic acids are oxalic acid, ascorbic acid, citric acid and fatty acids. Polymers containing carboxylic monomers are useful for use herein. Suitable polymers include homopolymers of acrylic acid and copolymers of acrylic acid with methacrylic acid and of acrylic acid or methacrylic acid with maleic acid. Especially preferred malodour-reducing agents for use herein are selected from the group consisting of citric acid, ascorbic acid, oxalic acid and mixtures thereof.

Dispersant polymers discussed in more detail herein below are very suitable for use as malodour reducing agent. In particular carboxylic based sulfonated polymers.

Dispersant Polymer

The polymer, if present, is used in any suitable amount from about 0.1% to about 30%, preferably from 0.5% to about 20%, more preferably from 1% to 10% by weight of the composition. Preferably the dispersant polymer is a sulfonated polymer, more preferably a sulfonated polymer comprising 2-acrylamido-2-methylpropane sulfonic acid monomers and carboxyl monomers.

Polycarboxylate Polymer

For example, a wide variety of modified or unmodified polyacrylates, polyacrylate/maleates, or polyacrylate/methacrylates are highly useful. It is believed these polymers are excellent dispersing agents and enhance overall detergent performance, particularly when used in the composition of the invention.

Suitable polycarboxylate-based polymers include polycarboxylate polymers that may have average molecular weights of from about 500 Da to about 500,000 Da, or from about 1,000 Da to about 100,000 Da, or even from about 3,000 Da to about 80,000 Da. Suitable polycarboxylates may be selected from the group comprising polymers comprising acrylic acid such as Sokalan PA30, PA20, PA15, PA10 and sokalan CP10 (BASF GmbH, Ludwigshafen, Germany), Acusol™ 45N, 480N, 460N and 820 (sold by Rohm and Haas, Philadelphia, Pa., USA) polyacrylic acids, such as Acusol™ 445 and Acusol™ 420 (sold by Rohm and Haas, Philadelphia, Pa., USA) acrylic/maleic co-polymers, such as Acusol™ 425N and acrylic/methacrylic copolymers.

Alkoxylated polycarboxylates such as those prepared from polyacrylates are useful herein to and can provide additional grease suspension. Chemically, these materials comprise polyacrylates having one ethoxy side-chain per every 7-8 acrylate units. The side-chains are ester-linked to the polyacrylate "backbone" to provide a "comb" polymer type structure. The molecular weight can vary, but may be in the range of about 2000 to about 50,000.

Unsaturated monomeric acids that can be polymerized to form suitable dispersing polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Co-polymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Sulfonated Polymers

Suitable sulfonated polymers described herein may have a weight average molecular weight of less than or equal to about 100,000 Da, preferably less than or equal to about 75,000 Da, more preferably less than or equal to about 50,000 Da, more preferably from about 3,000 Da to about 50,000, and specially from about 5,000 Da to about 45,000 Da.

The sulfonated polymers preferably comprises carboxylic acid monomers and sulfonated monomers. Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Specially preferred sulfonated polymers for use herein are those comprising monomers of acrylic acid and monomers of 2-acrylamido-methyl propane sulfonic acid.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas, Versaflex Si™ (sold by Alco Chemical, Tennessee, USA) and those described in U.S. Pat. No. 5,308,532 and in WO 2005/090541.

Suitable styrene co-polymers may be selected from the group comprising, styrene co-polymers with acrylic acid and optionally sulphonate groups, having average molecular weights in the range 1,000-50,000, or even 2,000-10,000 such as those supplied by Alco Chemical Tennessee, USA, under the tradenames Alcosperse® 729 and 747.

Other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates. Preferred cellulose-derived dispersant polymers are the carboxymethyl celluloses.

Yet another group of acceptable dispersing agents are the organic dispersing polymers, such as polyaspartates.

Amphilic graft co-polymer are useful for use herein. Suitable amphilic graft co-polymer comprises (i) polyethylene glycol backbone; and (ii) and at least one pendant moiety selected from polyvinyl acetate, polyvinyl alcohol and mixtures thereof. In other examples, the amphilic graft copolymer is Sokalan HP22, supplied from BASF.

Process for Making the Particle

The process comprises the step of adding the malodour-reducing agent to the nitrogen-containing cleaning-active. In order to obtain malodour reduction it is essential that malodour-reducing agent is added in the absence of water. Preferably, the nitrogen-containing cleaning-active is MGDA and the malodour-reducing agent is citric acid.

In a preferred embodiment a pre-particle containing the nitrogen-containing cleaning-active is made and then the pre-particle is admixed with the malodour-reducing agent, preferably the malodour-reducing agent is dusted onto the pre-particle.

In another preferred embodiment, the malodour-reducing agent is added as part of an anhydrous solution. The anhydrous solution can contain an organic solvent, non-ionic surfactant, etc.

Preferably, the malodour-reducing agent has a Dv 50 of from about 10 to about 100 μm, more preferably from about 20 to about 80 μm.

Particle Size Measurement: Laser Diffraction Method

This test method must be used to determine a fine powder's (e.g. raw materials like silica and sodium sulfate) Weight Median Particle Size (Dw50). The fine powder's Weight Median Particle Size (Dw50) is determined in accordance with ISO 8130-13, "Coating powders-Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; Sympatec GmbH of Clausthal-Zellerfeld, Germany; and Beckman-Coulter Incorporated of Fullerton, Calif., U.S.A.

The results are expressed in accordance with ISO 9276-1:1998, "Representation of results of particle size analysis-Part 1: Graphical Representation", Figure A.4, "Cumulative distribution Q3 plotted on graph paper with a logarithmic abscissa." The Median Particle Size is defined as the abscissa value at the point where the cumulative distribution (Q3) is equal to 50 percent.

Cleaning Composition

The particle of the invention is suitable for use in cleaning compositions, in particular powder compositions. Preferably, the composition of the invention is an automatic dishwashing composition.

The automatic dishwashing cleaning composition can be in the form of loose powder or presented in unit dose form. Preferably it is in unit dose form, unit dose forms include pressed tablets and water-soluble packs. The automatic dishwashing cleaning composition of the invention is preferably presented in unit-dose form. The composition of the invention is very well suited to be presented in the form of a multi-compartment pack, more in particular a multi-compartment pack comprising compartments with compositions in different physical forms, for example a compartment comprising a composition in solid form and another compartment comprising a composition in liquid form. The composition is preferably enveloped by a water-soluble film such as polyvinyl alcohol. Especially preferred are compositions in unit dose form wrapped in a polyvinyl alcohol film having a thickness of less than 100 μm. The detergent composition of the invention weighs from about 8 to about 25 grams, preferably from about 10 to about 20 grams. This weight range fits comfortably in a dishwasher dispenser. Even though this range amounts to a low amount of detergent, the detergent has been formulated in a way that provides all the benefits mentioned herein above.

The composition is preferably phosphate free. By "phosphate-free" is herein understood that the composition comprises less than 1%, preferably less than 0.1% by weight of the composition of phosphate.

Bleach

The composition of the invention preferably comprises from about 1 to about 20%, more preferably from about 5 to about 18%, even more preferably from about 8 to about 15% of bleach by weight of the composition.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein.

The percarbonate is most preferably incorporated into the products in a coated form which provides in-product stability.

Potassium peroxymonopersulfate is another inorganic perhydrate salt of utility herein.

Typical organic bleaches are organic peroxyacids, especially dodecanediperoxoic acid, tetradecanediperoxoic acid, and hexadecanediperoxoic acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acidlphthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5, preferably from 0.2 to 2% by weight of the composition of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the composition. Preferably the bleach catalyst is a manganese bleach catalyst.

Inorganic Builder

The composition of the invention preferably comprises an inorganic builder. Suitable inorganic builders are selected from the group consisting of carbonate, silicate and mixtures thereof. Especially preferred for use herein is sodium carbonate. Preferably the composition of the invention comprises from 5 to 50%, more preferably from 10 to 40% and especially from 15 to 30% of sodium carbonate by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]x[CH2CH2O]y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Enzymes

In describing enzyme variants herein, the following nomenclature is used for ease of reference: Original amino acid(s):position(s): substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference:V68A, N87S, S99D, S99SD, S99A, S101G, S101M, S103A, V104N/I, G118V, G118R, S128L, P129Q, S130A, Y167A, R170S, A194P, V2051 and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+S130A (iii) N76D+N87R+G118R+S128L+P129Q+S130A+S188D+N248R (iv) N76D+N87R+G118R+S128L+P129Q+S130A+S188D+V244R (v) N76D+N87R+G118R+S128L+P129Q+S130A (vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 7 and especially from about 1 to about 6 mg of active protease.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 5%, more preferably from 0.05 to 3% and especially from 0.5 to 2% of a crystal growth inhibitor by weight of the product, preferably HEDP.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.1 to 5%, more preferably from 0.2 to 4% and specially from 0.3 to 3% by weight of the composition of a metal care agent, preferably the glass care agent is a zinc containing material, specially hydrozincite.

The automatic dishwashing composition of the invention preferably has a pH as measured in 1% weight/volume aqueous solution in distilled water at 20° C. of from about 9 to about 12, more preferably from about 10 to less than about 11.5 and especially from about 10.5 to about 11.5.

The automatic dishwashing composition of the invention preferably has a reserve alkalinity of from about 10 to about 20, more preferably from about 12 to about 18 at a pH of 9.5 as measured in NaOH with 100 grams of product at 20° C.

A preferred automatic dishwashing composition of the invention include:

i) from 5 to 50% by weight of the composition of a particle comprising MGDA and dusted citric acid.
ii) from 5 to 20% by weight of the composition of bleach, preferably sodium percarbonate;
iii) preferably a bleach activator, more preferably TAED;
iv) enzymes, preferably amylases and proteases;
v) optionally but preferably from 5 to 30% by weight of the composition of an inorganic builder, preferably sodium carbonate;
vi) optionally but preferably from 2 to 10% by weight of the composition of a non-ionic surfactant;
vii) optionally but preferably a bleach catalyst, more preferably a manganese bleach catalyst;
viii) other optional ingredients include: a crystal growth inhibitor, preferably HEDP, and glass care agents.

Detergent Pack

The detergent pack can be a tub, tray, jar, bottle, bag, box, etc, preferably the pack is reclosable. Preferably the packaging container has a moisture vapour transfer rate of less than 0.25 g/m2/day at 38° C. and 90% relative humidity. Suitable packaging containers for use herein include those described in WO 02/20361. A specially preferred packaging container is a self-standing flexible bag as described in WO 03/047998 page 4, lines 6 to 26 and FIG. 1, preferably with a non-return valve. Preferably the pack is a reclosable flexible bag and preferably self-standing. By "flexible" bag is understood a bag which can be easily deformed with a hand squeeze, preferably deformed by the mere act of holding the bag.

EXAMPLES

Particles comprising a nitrogen-containing cleaning-active (MGDA) were mixed with bleach particles (sodim percarbonate) and a filler (sodium sulphate). Compositions 1 and 3 comprise particles outside the scope of the invention and composition 2 comprises a particle made according to the process of the invention.

| Ingredients (grams stock of material) | Composition 1 | Composition 2 | Composition 3 |
|---|---|---|---|
| Sodium percarbonate | 13.11 | 13.11 | 13.11 |
| Trilon M | 50.45 | | |
| Particle A (Trilon M Sprayed on citric (1.1%)) | | | 51.26 |
| Particle B (Trilon M Dusted citric (1%)) | | 50.95 | |
| Sodium sulphate balance to 100% | 36.44 | 35.94 | 35.63 |

Trilon M Three sodium salt of methyl glycine diacetic acid, particle size 400-600 microns, supplied by BASF Particle Making Particle A 100 g of a saturated solution was made with 58 g of anhydrous citric acid and water. 500 g of Trilon M were placed into a mixer. Using 3 bar pressure in a mini spray rig, 10 g of citric acid solution were slowly sprayed on the Trilon M particles. It took about 1 minute to spray on the 10 g. The mixture was dried in a Sherwood fluid bed at 120° C. until moisture was less than 1% by weight of the particle. Final citric acid level in the particles was 1.1% by weight of the particles.

Particle B 99 g of Trilon M and 1 g of commercially available anhydrous citric acid, previously ground to a particle size of 40-70 microns were added into a Pascall tumbling mixer (1 kg capacity mixing bowl) and blended together at a speed where cascading flow was achieved.

Procedure for Malodour Testing 100 g of each composition were placed into a bag and sealed. The bag used was a zip lock bag made of laminated polyethylene (12 micron thickness) and laminated polyethylene terephthalate (80 microns). The bag dimensions were: 19 cm height, 8.2 cm width and 19 cm length. The bag was then placed in a 32° C., 80% relative humidity oven for 3 weeks and sampled at regular intervals. Sampling involved piercing the bag with an ammonia detector tube fitted to a Kitagawa (AP-20) gas aspirating pump to measure the concentration of airborne ammonia in the headspace of the bag.

To measure the ammonia concentration two different detection ranges had to be used as the levels of ammonia were considerably different between the two samples. (105SD 0.2 to 20 ppm and 105SC 5-260 ppm).

Results

| Ammonia measured (ppm) | 1 day | 7 days | 21 days |
|---|---|---|---|
| Composition 1 (Trilon M) | 60 | 100 | 100 |
| Composition 1b (Trilon M + water) | 25 | 110 | 110 |
| Composition 2 (Trilon M + liquid citric acid spray on (1.1%)) | 0.2 | 0.2 | 150 |
| Composition 3 (Trilon M + citric acid dusted 1%) | 0 | 0 | 2 |

As it can be seen from FIG. 1 the composition comprising the particle made according to the process of the invention avoids the generation of ammonia. This is translated into elimination of malodour.

Composition 1b contains the same amount of water sprayed-on as Composition 2 and demonstrates that the malodour of Composition 2 is not the result of the added water as the malodour profile is similar to that of Composition 1 with no added water.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making a particle, the particle comprising:

a) a nitrogen-containing cleaning-active in the form of a salt wherein the salt has a pH in 1% weight aqueous solution measured at 25° C. greater than 9; and b) a malodour-reducing agent comprising an acid group wherein the process comprises the step of adding the malodour-reducing agent to the nitrogen-containing cleaning-active and wherein the malodour-reducing agent is added in the absence of water, wherein the malodour-reducing agent is added as an anhydrous solution.

2. A process according to claim 1 comprising the step of forming a pre-particle containing the nitrogen-containing cleaning-active and admixing the pre-particle with the malodour-reducing agent wherein both the pre-particle and the malodour-reducing agent are in solid form.

3. A process according to claim 1 wherein the acid group is a carboxylic monomer and wherein the malodour-reducing agent is a carboxylic acid selected from the group consisting of citric acid, ascorbic acid, oxalic acid, adipic acid, succinic acid, glutaric acid, malic acid, tartaric acid, maleic acid, fumaric acid, sugar acids, fatty acids and mixtures thereof.

4. A process according to claim 1 wherein the malodour-reducing agent is a polymer comprising carboxylic and sulfonic groups.

5. A process according to claim 1 wherein the malodour-reducing agent has a Dv 50 of from about 10 to about 100 μm.

6. A process according to claim 1 wherein part of the nitrogen in the nitrogen-containing cleaning-active is in the form of an amine.

7. A process according to claim 1 wherein the nitrogen-containing cleaning-active is selected from the group consisting of salts of aminocarboxylic complexing agents, amine oxide surfactants, polymers comprising nitrogen and mixtures thereof.

8. A process according to claim 7 wherein the aminocarboxylic complexing agent is selected from the group consisting of salts of methyl glycine diacetic acid (MGDA), salts of glutamic-N,N-diacetic acid (GLDA) and mixtures thereof.

9. A process according to claim 1 wherein the malodour-reducing agent is selected from the group consisting of citric acid, ascorbic acid, oxalic acid, adipic acid, succinic acid, glutaric acid, malic acid, tartaric acid, maleic acid, fumaric acid, sugar acids, fatty acids and mixtures thereof.

10. A process according to claim 1 wherein the nitrogen-containing cleaning-active is a salt of MGDA and the malodour-reducing agent is citric acid.

* * * * *